US006747201B2

(12) United States Patent
Birmingham et al.

(10) Patent No.: US 6,747,201 B2
(45) Date of Patent: Jun. 8, 2004

(54) METHOD AND SYSTEM FOR EXTRACTING MELODIC PATTERNS IN A MUSICAL PIECE AND COMPUTER-READABLE STORAGE MEDIUM HAVING A PROGRAM FOR EXECUTING THE METHOD

(75) Inventors: William P. Birmingham, Ann Arbor, MI (US); Colin J. Meek, Ann Arbor, MI (US)

(73) Assignee: The Regents of the University of Michigan, Ann Arbor, MI (US)

( * ) Notice: Subject to any disclaimer, the term of this patent is extended or adjusted under 35 U.S.C. 154(b) by 423 days.

(21) Appl. No.: 09/965,051

(22) Filed: Sep. 26, 2001

(65) Prior Publication Data

US 2003/0089216 A1 May 15, 2003

(51) Int. Cl.[7] ..... G04B 13/00; G10H 7/00

(52) U.S. Cl. ..... 84/609; 84/611; 84/616; 84/649; 84/651; 84/654

(58) Field of Search ..... 84/600–603, 609–614, 84/615–618, 626–627, 649–656, 662–663

(56) References Cited

U.S. PATENT DOCUMENTS

| | | | | |
|---|---|---|---|---|
| 5,018,427 A | | 5/1991 | Uchiyama | |
| 5,375,501 A | * | 12/1994 | Okuda | 84/611 |
| 5,402,339 A | | 3/1995 | Nakashima et al. | |
| 5,440,756 A | | 8/1995 | Larson | |
| 5,486,646 A | | 1/1996 | Yamashita et al. | |
| 5,712,437 A | | 1/1998 | Kageyama | |
| 5,760,325 A | | 6/1998 | Aoki | |
| 5,874,686 A | | 2/1999 | Ghias et al. | |
| 5,963,957 A | | 10/1999 | Hoffberg | |
| 6,124,543 A | | 9/2000 | Aoki | |
| 6,486,390 B2 | * | 11/2002 | Aoki et al. | 84/611 |
| 6,576,828 B2 | * | 6/2003 | Aoki et al. | 84/635 |

FOREIGN PATENT DOCUMENTS

| | | |
|---|---|---|
| JP | 3276197 | 12/1991 |
| JP | 11143460 | 5/1999 |

* cited by examiner

*Primary Examiner*—Marlon T. Fletcher
(74) *Attorney, Agent, or Firm*—Brooks & Kushman P.C.

(57) ABSTRACT

A method and system for extracting melodic patterns by first recognizing musical "keywords" or themes. The invention searches for all instances of melodic (intervallic) repetition in a piece (patterns). This process generally uncovers a large number of patterns, many of which are either uninteresting or are only superficially prevalent. Filters reduce the number and/or prevalence of such patterns. Patterns are then rated according to characteristics deemed perceptually significant. The top ranked patterns correspond to important thematic or motivic musical content. The system operates robustly across a broad range of styles, and relies on no metadata on its input, allowing it to independently and efficiently catalog multimedia data.

45 Claims, 5 Drawing Sheets

For each pattern occurrence $o$:

- $o_{right}$ ⟵ occurrence pointed to by the first event of occurrence $0$.
- $o_{left}$ ⟵ occurrence pointed to by the event preceding the first event of occurrence $0$.
- Consider three cases for the value of $o_{left}$:
  1. If it is a null value, $o_{left}$ tells nothing new about the lattice structure.
  2. If it is an occurrence of greater length, $o_{left}$ is the parent of $o$.
  3. If it is an occurrence of the same length, $o_{left}$ is the left sibling of $o$, and $o_{left}$'s right parent is $o$'s left parent.
- Consider two cases for the value of $o_{right}$:
  1. If it is a null value, $o_{right}$ tells nothing new about the lattice structure.
  2. Otherwise, $o_{right}$ is the right parent of $o$.
- Then point the first event of $o$ to $o$

Fig. 3

For each pattern $P$:

- $f$ ⟵ 0, initialize frequency
- By breadth-first traversal, add $P$ and all patterns covered by an occurrence of $P$ in the lattice to a queue $Q$, tagging patterns as they are added such that none are included twice.
- For each pattern $P_{subset}$ in $Q$:
  - For each occurrence $o_{subset}$ in $P_{subset}$:

If the first and last events of $o_{subset}$ are un-tagged, then assume the occurrence has not been counted even in part, since previously considered occurrences are necessarily of greater or equal length. All events in the occurrence are then tagged, and set $f \longrightarrow f + \frac{length[o_{subset}]}{length[P]}$

Fig. 4

Given the input set of events $E$:

- Sort the events in $E$ according to onset times.
- Set active list $L \leftarrow null$
- For each $e$ in $E$:
  - Add $e$ to $L$, and all subsequent events with the same onset.
  - Remove all events in $L$ with offset times $\leq O_{nset}[e]$, so that only concurrent events are stored. Note that the events sharing endpoints are not considered overlapping.
  - Sort elements in $L$ according to pitch.
  - Set $n \leftarrow Size[L]$
  - For each $e_{active}$ in $L$:
    - * Set r $\leftarrow$ index of $e_{active}$ in $L/(n - 1)$, which assigns values in the range [0, 1] for register, or simply 0 if it is the only active event, to avoid division by zero, and to reflect the ease with which the ear can pick out a line in isolation.
    - * If $r > Register[e_{active}]$, set $Register[e_{active}] \leftarrow r$, so that the worst register score found for a particular event is the one kept. This also allows one to consider only onset times, since an event may have better register ratings at an offset point for another event, but never worse ones.

Fig. 5

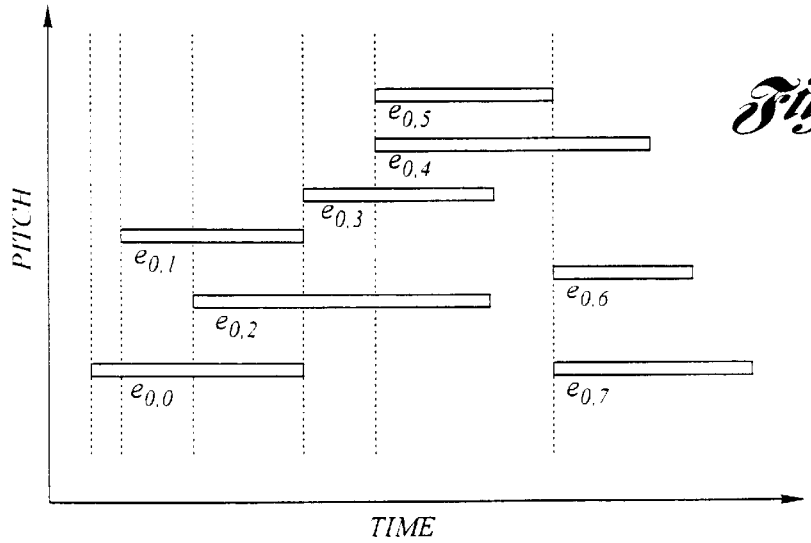

Fig. 6

```
For each pattern P, with occurences o0, o1, ..., on-1, and length m:
    for i ← 0 to n - 2
        for j ← i + 1 to n - 1
            if ¬Remove[i] ∧ ¬Remove[j]
                Simultaneously ← true
                for k ← 0 to l
                    if ¬Intersects(e_Stream[oi],Index[oi]-k,e_Stream[oj],Index[oj]+k) then
                    Simultaneous ← false
                    k ← l - 1
                If Simultaneous then
                    if Pitch[e_Stream[oi],Index[oi]] > Pitch(e_Stream[oj],Index[oj]] then
                        Remove[j] ← true
                    else
                        Remove[i] ← true
                    else
                        j ← n Δcurtail search for double with oi
        Remove all occurences i for which Remove[i] is true
        Set Doubling[P] ← the number of doublings removed
```

Fig. 7

(*Barlow Ranking/Invention*)

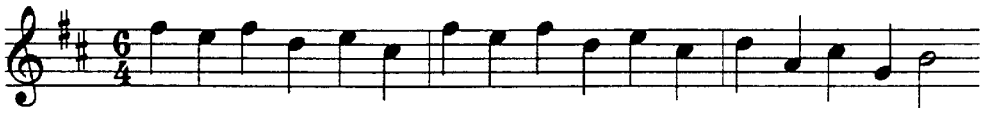

(1/3)

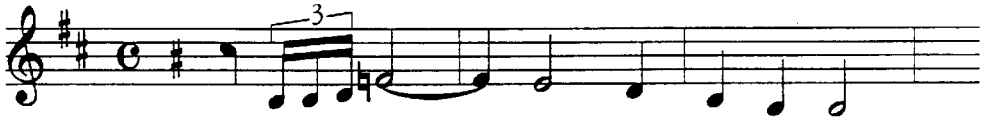

(2/2)

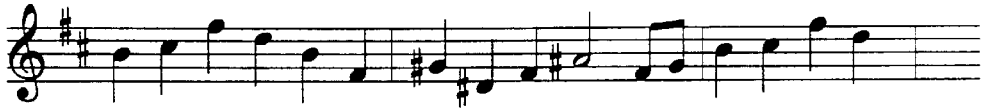

(3/1)

Fig. 9

METHOD AND SYSTEM FOR EXTRACTING MELODIC PATTERNS IN A MUSICAL PIECE AND COMPUTER-READABLE STORAGE MEDIUM HAVING A PROGRAM FOR EXECUTING THE METHOD

STATEMENT REGARDING FEDERALLY SPONSORED RESEARCH OR DEVELOPMENT

This invention was made with government support under National Science Foundation Grant No. 9872057. The government has certain rights in the invention.

BACKGROUND OF THE INVENTION

1. Field of the Invention

This invention relates to methods and systems for extracting melodic patterns in musical pieces and computer-readable storage medium having a program for executing the method.

2. Background Art

Extracting the major themes from a musical piece: recognizing patterns and motives in the music that a human listener would most likely retain (i.e. "Thematic extraction") has interested musician and AI researchers for years. Music librarians and music theorists create thematic indices (e.g., Köchel catalog) to catalog the works of a composer or performer. Moreover, musicians often use thematic indices (e.g., Barlow's *A Dictionary of Musical Themes*) when searching for pieces (e.g., a musician may remember the major theme, and then use the index to find the name or composer of that work). These indices are constructed from themes that are manually extracted by trained music theorists. Construction of these indices is time consuming and requires specialized expertise.

Theme extraction using computers has proven very difficult. The best known methods require some 'hand tweaking' to at least provide clues about what a theme may be, or generate thematic listings based solely on repetition and string length. Yet, extracting major themes is an extremely important problem to solve. In addition to aiding music librarians and archivists, exploiting musical themes is key to developing efficient music retrieval systems. The reasons for this are twofold. First, it appears that themes are a highly attractive way to query a music-retrieval system. Second, because themes are much smaller and less redundant, by searching a database of themes rather than full pieces, one can simultaneously get faster retrieval (by searching a smaller space) and get increased relevancy. Relevancy is increased as only crucial elements, variously named "motives," "themes," "melodies" or "hooks," are searched, thus reducing the chance that less important, but commonly occurring, elements will fool the system.

There are many aspects to music, such as melody, harmony, and rhythm, each of which may affect what one perceives as major thematic material. Extracting themes is a difficult problem for many reasons, among these are the following:

- The major themes may occur anywhere in a piece. Thus, one cannot simply scan a specific section of piece (e.g., the beginning).
- The major themes may be carried by any voice. For example, in FIG. 1, the principal theme is carried by the viola, the third lowest voice. Thus, one cannot simply "listen" to the upper voices.
- There are highly redundant elements that may appear as themes, but should be filtered out. For example, scales are ubiquitous, but rarely constitute a theme. Thus, the relative frequency of a series of notes is not sufficient to make it a theme.

The U.S. patent to Larson (U.S. Pat. No. 5,440,756) discloses an apparatus and method for real-time extraction and display of musical chord sequences from an audio signal. Disclosed is a software-based system and method for real-time extraction and display of musical chord sequences from an audio signal.

The U.S. patent to Kageyama (U.S. Pat. No. 5,712,437) discloses an audio signal processor selectively deriving harmony part from polyphonic parts. Disclosed is an audio signal processor comprising an extracting device that extracts selected melodic part from the input polyphonic audio signal.

The U.S. patent to Aoki (U.S. Pat. No. 5,760,325) discloses a chord detection method and apparatus for detecting a chord progression of an input melody. Of interest is a chord detection method and apparatus for automatically detecting a chord progression of input performance data. The method comprises the steps of detecting a tonality of the input melody, extracting harmonic tones from each of the pitch sections of the input melody and retrieving the applied chord in the order of priority with reference to a chord progression.

The U.S. patent to Aoki (U.S. Pat. No. 6,124,543) discloses an apparatus and method for automatically composing music according to a user-inputted theme melody. Disclosed is an automated music composing apparatus and method. The apparatus and method includes a database of reference melody pieces for extracting melody generated data which are identical or similar to a theme melody inputted by the user to generate melody data which define a melody which matches the theme melody.

The Japanese patent document of Igarashi (JP3276197) discloses a melody recognizing device and melody information extracting device to be used for the same. Described is a system for extracting melody information from an input sound signal that compares information with the extracted melody information registered in advance.

The Japanese patent document of Kayano et al. (JP11143460) discloses a method for separating, extracting by separating, and removing by separating melody included in musical performance. The reference describes a method of separating and extracting melody from a musical sound signal. The sound signal for the melody desired to be extracted is obtained by synthesizing and adding the waveform based on the time, the amplitude, and the phase of the selected frequency component.

U.S. Pat. Nos. 5,402,339; 5,018,427; 5,486,646; 5,874,686; and 5,963,957 are of a more general interest.

SUMMARY OF THE INVENTION

An object of the present invention is to provide an improved method and system for extracting melodic patterns in a musical piece and computer-readable storage medium having a program for executing the method wherein such extraction is performed from abstracted representations of music.

Another object of the present invention is to provide a method and system for extracting melodic patterns in a musical piece and computer-readable storage medium having a program for executing the method, wherein the extracted patterns are ranked according to their perceived importance.

In carrying out the above objects and other objects of the present invention, a method for extracting melodic patterns in a musical piece is provided. The method includes receiving data which represents the musical piece, segmenting the data to obtain musical phrases, and recognizing patterns in each phrase to obtain a pattern set. The method further includes calculating parameters including frequency of occurrence for each pattern in the pattern set and identifying desired melodic patterns based on the calculated parameters.

The method may further include filtering the pattern set to reduce the number of patterns in the pattern set.

The data may be note event data.

The step of segmenting may include the steps of segmenting the data into streams which correspond to different voices contained in the musical piece and identifying obvious phrase breaks.

The step of calculating may include the step of building a lattice from the patterns and identifying non-redundant partial occurrences of patterns from the lattice.

The parameters may include temporal interval, rhythmic strength and register strength.

The step of identifying the desired melodic patterns may include the step of rating the patterns based on the parameters.

The step of rating may include the steps of sorting the patterns based on the parameters and identifying a subset of the input piece containing the highest-rated patterns.

The melodic patterns may be major themes.

The step of recognizing may be based on melodic contour.

The step of filtering may include the step of checking if the same pattern is performed in two voices substantially simultaneously.

The step of filtering may be performed based on intervallic content or internal repetition.

Further, in carrying out the above objects and other objects of the present invention, a system for extracting melodic patterns in a musical piece is provided. The system includes means for receiving data which represents the musical piece, means for segmenting the data to obtain musical phrases, and means for recognizing patterns in each phrase to obtain a pattern set. The system further includes means for calculating parameters including frequency of occurrence for each pattern in the pattern set and means for identifying desired melodic patterns based on the calculated parameters.

The system may further include means for filtering the pattern set to reduce the number of patterns in the pattern set.

The means for segmenting may include means for segmenting the data into streams which correspond to different voices contained in the musical piece, and means for identifying obvious phrase breaks.

The means for calculating may include means for building a lattice from the patterns and means for identifying non-redundant partial occurrences of patterns from the lattice.

The means for identifying the desired melodic patterns may include means for rating the patterns based on the parameters.

The means for rating may include means for sorting the patterns based on the parameters and means for identifying a subset of the input piece containing the highest-rated patterns.

The means for recognizing may recognize patterns based on melodic contour.

The means for filtering may include means for checking if the same pattern is performed in two voices substantially simultaneously.

The means for filtering may filter based on intervallic content or internal repetition.

Still further in carrying out the above objects and other objects of the present invention, a computer-readable storage medium is provided. The medium has stored therein a program which executes the steps of receiving data which represents a musical piece, segmenting the data to obtain musical phrases, and recognizing patterns in each phrase to obtain a pattern set. The program also executes the steps of calculating parameters including frequency of occurrence for each pattern in the pattern set and identifying desired melodic patterns based on the calculated parameters.

The program may further execute the step of filtering the pattern set to reduce the number of patterns in the pattern set.

The method and system of the invention automatically extracts themes from a piece of music, where music is in a "note" representation. Pitch and duration information are given, though not necessarily metrical or key information. The invention exploits redundancy that is found in music: composers will repeat important thematic material. Thus, by breaking a piece up into note sequences and seeing how often sequences repeat, the themes are identical. Breaking up involves examining all note sequence lengths of two to some constant. Moreover, because of the problems listed earlier, one examines the entire piece and all voices. This leads to very large numbers of sequences, thus the invention uses a very efficient algorithm to compare these sequences.

Once repeating sequences have been identified, they are characterized with respect to various perceptually important features in order to evaluate their thematic value. These features are weighed for the thematic value function. For example, the frequency of a pattern is a stronger indication of thematic importance than pattern register. Hill-climbing techniques are implemented to learn weights across features. The resulting evaluation function then rates the sequence patterns uncovered in a piece.

The above objects and other objects, features, and advantages of the present invention are readily apparent from the following detailed description of the best mode for carrying out the invention when taken in connection with the accompanying drawings.

BRIEF DESCRIPTION OF THE DRAWINGS

FIG. 3 is a description of a lattice construction algorithm of the present invention;

FIG. 4 is a description of a frequency determining algorithm of the present invention;

FIG. 5 is a description of an algorithm of the present invention for calculating register;

FIG. 6 is a graph of pitch versus time for a register, example piece;

FIG. 7 is a description of an algorithm of the present invention for identifying doublings;

FIG. 9 is a representation of three major musical themes.

DETAILED DESCRIPTION OF THE PREFERRED EMBODIMENTS

Input to the method and system of the present invention is a set of note events making up a musical composition $N=\{n_1, n_2 \ldots n_3\}$. A note event is a triple consisting of an onset time, an offset time and a pitch (in MIDI note numbers, where 60='Middle C' and the resolution is the semi-tone): $n_i$=<onset, offset, pitch>. Several other valid representations of a musical composition exists, taking into account amplitude, timbre, meter and expression markings among others. However, pitch is reliably and consistently stored in MIDI files—the most easily accessible electronic representation for music—and voice contour may be a measure of redundancy.

However, it is to be understood that the method and system of the invention is capable of using input data that are not strictly notes but are some abstraction of notes to represent a musical composition or piece. For example, instead of saying the pitch C4 (middle C on the piano) lasting for 1 beat, one could say X lasting for about N time units. Consequently, other representations other than the particular input data described herein are not only possible but may be desirable.

Algorithm

In this section the operation of an algorithm of the present invention is described. This includes identifying patterns and process of computing pattern characteristics, such that "interesting" patterns can be identified.

Figure 1:
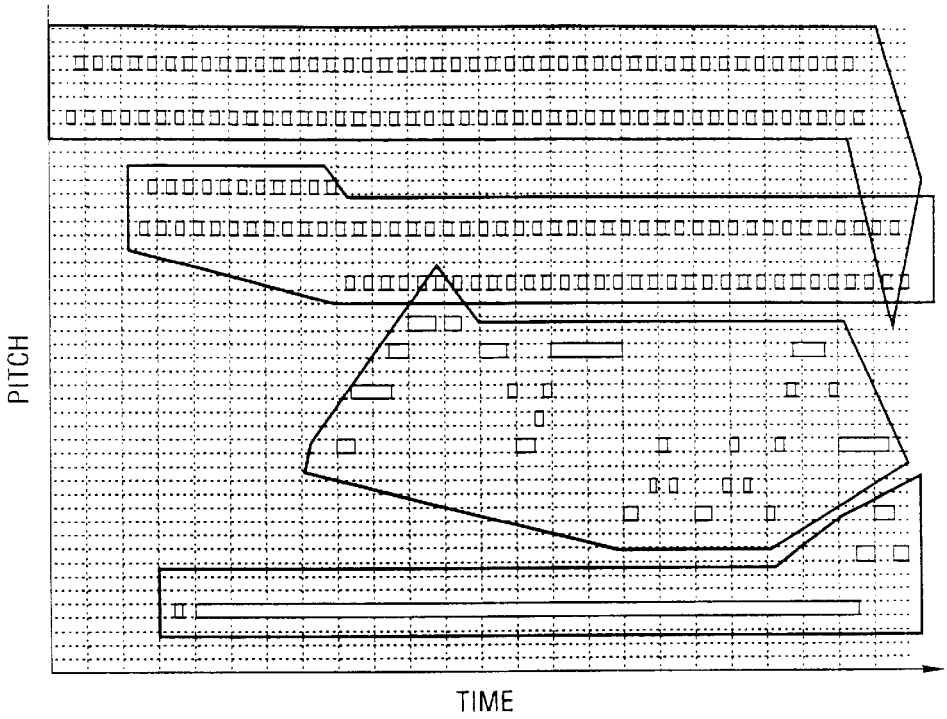
FIG. 1 is a graph of pitch versus time of the opening phrase of Antonin Dvorak's *"American" Quartet;*

The algorithm extracts "melodic motives," characteristic sequences of non-concurrent note events. Much of the input material however contains concurrent events, which must be divided into "streams," corresponding to "voices" in the music. In both notated and MIDI form, music is generally grouped by instrument, so that musical streams have been identified in advance. FIG. 1 shows a relatively straightforward example of segmentation, from the opening of Dvorak's "*American" Quartet,* where four voices are present. In cases where several concurrent voices are present in one instrument, for example in piano music, only the top sounding voice is dealt with. This is clearly a compromise solution, as certain events are disregarded. Although some existing analysis tools perform stream segregation on abstracted music, (i.e., note event representation), they have trouble with overlapping voices, as seen between the middle voices in FIG. 1.

Stream Segregation

Events are thus indexed according to stream number and position in stream, so that the fifth event of the fourth stream will be notated as follows, using the convention that the first element is indicated by index 0: $e_{3,4}$. For instance, the first stream contains events $e_0=\{e_{0,0}, e_{0,1}, \ldots, e_{0,|n-1|}\}$.

Identifying Patterns

The invention is primarily concerned with melodic contour as an indicator of redundancy. Contour is defined as the sequence of pitch intervals across a sequence of note events in a stream. For instance, the stream consisting of the following event sequence $e_s=\{$<0, 1, 60>, <1, 2, 62>, <2, 3, 64>, <3, 4, 62>, <4, 5, 60>$\}$ has contour $c_s=\{+2, +2, -2, -2\}$. The invention considers contour in terms of "simple interval," which means that although the sign of an interval (+/−) is considered, octave is not. As such, an interval of +2 is considered equivalent to an interval of +14=(+2+octave=+2+12). Each interval corresponding to an event, i.e., the interval between that event and its successor, is normalized to the range [−12,+12]:

$$\text{real_interval}_{s,i}=\text{Pitch}[e_{s,i+1}]-\text{Pitch}[e_{s,i}]$$

$$c_{s,i}=\begin{cases}\text{real_interval}_{s,i}, & \text{if } -12 \le \text{real_interval}_{s,i} \le +12 \\ -\text{mod}_{12}-\text{real_interval}_{s,i} & \text{if real_interval}_{s,i} \le -12 \\ \text{mod}_{12}\text{real_interval}_{s,i} & \text{otherwise}\end{cases} \quad (1)$$

To efficiently uncover patterns, or repeating interval sequences, a key k(m) is assigned to each event in the piece that uniquely identifies a sequence of m intervals. Length refers to the number of intervals in a pattern, not the number of events. The keys must exhibit the following property:

$$k_{p_1,i_1}(m)=k_{p_2,i_2}(m) \Leftrightarrow \{c_{p_1,i_1}, c_{p_1,i_1+1}, \ldots, c_{p_1,i_1+m-1}\}=\{c_{p_2,i_2}, c_{p_2,i_2+1}, \ldots, c_{p_2,i_2+m-1}\}$$

Since only 25 distinct simple intervals exist, one can refer to intervals in radix-26 notation, reserving a digit (0) for the ends of streams. An m-digit radix-26 number, where each digit corresponds to an interval in sequence, thus uniquely identifies that sequence of intervals, and key values can then be calculated as follows, re-mapping intervals to the range [1,25]:

$$k_{p,i}(m)=\sum_{j=0}^{m-1}(c_{i+j}+12)*26^{M-j-1} \quad (2)$$

The following derivations allow one to more efficiently calculate the value of $k_{p,i}$:

$$k_{p,i}(1)=c_i+13 \quad (3)$$

$$k_{p,i+1}(n)=\begin{cases}26*k_{p,i}(n-1)+k_{p,i+n-1}(1), & \text{if } n \le |c_p|-i \\ k_{p,i}(|c_p|-i)*26^{(n-|c_p|+i)} & \text{if } n > |c_p|-1\end{cases} \quad (4)$$

$$k_{p,i+1}(n-1)=k_{p,i}(n)-(c_i+13)*26^{n-1} \quad (5)$$

$$k_{p,i+1}(n)=26*k_{p,i+1}(n-1)+k_{p,i+n}(1) \quad (6)$$

Using formulae 3 and 4, one can calculate the key of the first event in a phrase in linear time with respect to the maximum pattern length, or the phrase length, whichever is smaller (this is essentially an application of Horner's Rule). Formulae 5 and 6 allow one to calculate the key of each subsequent event in constant time (as with the Rabin-Karp algorithm). As such, the overall complexity for calculating keys is $\Theta(n)$ with respect to the number of events.

One final derivation is employed in the pattern identification:

$$\forall m,\ 0 < m \le n : k_{p,i}(m)=\left\lfloor \frac{k_{p,i}(n)}{24^{n-m}} \right\rfloor \quad (7)$$

Events are then sorted on key so that pattern occurrences are adjacent in the ordering. A pass is made through the list for pattern lengths from m=[n . . . 2], resulting in a set of patterns, ordered from longest to shortest. The procedure is straightforward: during each pass through the list, keys are grouped together for which the value of k(m)—calculated using Formula 7—is invariant. Such groups are consecutive in the sorted list. Occurrences of a given pattern are then ordered according to onset time, a necessary property for later operations.

Consider the following simple example for n=4, a single phrase from Mozart's *Symphony No.* 40: $e_0=\{$<0, 1, 48>, <1, 2, 47>, <2, 4, 47>, <4, 5, 48>, <5, 6, 47>, <6, 8, 47>, <8, 9, 48>, <9, 10, 47>, <10, 12, 47>, <12, 16, 55>}. This phrase has intervals: $c_0=\{-1, 0, 1, -1, 0, 1, -1, 0, 8\}$.

First, one calculates the key value for the first event ($k_0(4)$), using Formulae 3 and 4 recursively.

$$k_{0,0}(1)=12$$

$$k_{0,0}(2)=26*k_{0,0}(1)+k_{0,1}(1)=26*12+13=325$$

$$k_{0,0}(3)=26*k_{0,0}(2)+k_{0,2}(1)=26*325+14=8464$$

$$k_{0,0}(4)=26*k_{0,0}(3)+k_{0,3}(1)=26*8464+12=22076$$

Then the remaining key values are calculated using Formulae 5 and 6:

$$k_{0,1}(3)=k_{0,0}(4)-12*26^3$$

$$k_{0,1}(4)=26*k_{0,1}(3)+k_{0,4}(1)=26*9164+13=238277$$

$$k_{0,2}(4)=254528\ k_{0,3}(4)=220076\ k_{0,4}(4)=238277\ k_{0,5}(4)=254535$$

$$k_{0,6}(4)=220246\ k_{0,7}(4)=242684\ k_{0,8}(4)=369096\ k_{0,9}(4)=0$$

Sorting these keys, one gets: $\{k_{0,9}, k_{0,0}, k_{0,3}, k_{0,6}, k_{0,1}, k_{0,4}, k_{0,7}, k_{0,2}, k_{0,5}, k_{0,8}\}$ On a first pass through the list, for m=4, patterns $\{k_{0,0}, k_{0,3}\}$ and $\{k_{0,1}, k_{0,4}\}$ and $\{k_{0,2}, k_{0,5}\}$, noting that $\lfloor k_{0,2}/26^{4-3}\rfloor=\lfloor k_{0,5}/26^{4-3}\rfloor$, which entails that an additional pattern of length 3 exists. Similarly, the following patterns are identified for m=2: $\{k_{0,0}, k_{0,3}, k_{0,6}\}$, $\{k_{0,1}, k_{0,4}\}$ and $\{k_{0,2}, k_{0,5}\}$. The patterns are shown in Table 1.

TABLE 1

Patterns in opening phrase of Mozart's Symphony No. 40

| Pattern | Occurrences at | Characteristic interval pattern |
|---|---|---|
| $P_0$ | $e_{0,0}$, $e_{0,3}$ | {−1, 0, +1, −1} |
| $P_1$ | $e_{0,1}$, $e_{0,4}$ | {0, +1, −1, 0} |
| $P_2$ | $e_{0,0}$, $e_{0,3}$ | {−1, 0, +1} |
| $P_3$ | $e_{0,1}$, $e_{0,4}$ | {0, +1, −1} |
| $P_4$ | $e_{0,2}$, $e_{0,5}$ | {+1, −1, 0} |
| $P_5$ | $e_{0,0}$, $e_{0,3}$, $e_{0,6}$ | {−1, 0} |
| $P_6$ | $e_{0,1}$, $e_{0,4}$ | {0, +1} |
| $P_7$ | $e_{0,2}$, $e_{0,5}$ | {+1, −1} |

A vector of parameter value $V_t=<v_1, v_2, \ldots, v_l>$ and a sequence of occurrences are associated to each pattern. Length, $v_{length}$, is one such parameter. The assumption was made that longer patterns are more significant, simply because they are less likely to occur by chance.

Frequency of Occurrence

Frequency of occurrence is one of the principal parameters considered by the invention in establishing pattern importance. All other things being equal, higher occurrence frequency is considered an indicator of higher importance. The definition of frequency is complicated by the inclusion of partial pattern occurrences. For a particular pattern, characterized by the interval sequence $\{C_0, C_1, \ldots, C_{v_{length}-1}\}$, the frequency of occurrences is defined as follows:

$$\sum_{l=v_{length}}^{2}\ \sum_{j=0}^{v_{length}-l} \frac{\text{non-redundant occurrences of } \{C_j, C_{j+1}, \ldots, C_{j+l-1}\}}{\text{length}/v_l} \tag{8}$$

An occurrence is considered non-redundant if it has not already been counted, or partially counted (i.e., it contains part of another occurrence that is longer or precedes it.) Consider the piece consisting of the following interval sequence, in the stream $e_0$: $c_0=\{-2,2, -2,2, -5,5, -2,2, -2,2, -5,5, -2,2, -2,2\}$, and the pattern $\{-2,2, -2,2, -5\}$. Clearly, there are two complete occurrences at $e_{0,0}$ and $e_{0,6}$, but also a partial occurrence of length 4 at the $e_{0,12}$. In this case, the frequency is equal to $$2\frac{4}{5}.$$

To efficiently calculate frequency, one first constructs a set of pattern occurrence lattices, on the following binary occurrence relation (≺):

Given occurrences $o_1$ and $o_2$ characterized by intervals $$C[o_1]=\{c_{1_1}, c_{1_2}, \ldots, c_{1_n}\}$$
$$C[o_2]=\{c_{2_1}, c_{2_2}, \ldots, c_{2_m}\} \tag{9}$$

One has the following relation:

$$C[o_1]\subset C[o_2]\Leftrightarrow o_1\prec o_2$$

As such, in establishing occurrence frequency for pattern P, one need consider only those patterns covered by occurrences in P in the lattices. Two properties of the data facilitate this construction:

1. The pattern identification procedure adds patterns in reverse order of pattern length.

2. For any pattern occurrence of length n>2, there are two occurrences of length n−1, one sharing the same initial event, one sharing the same final event. Clearly, these shorter occurrences also constitute patterns. The lattices then have a branching factor of 2.

Figure 2:
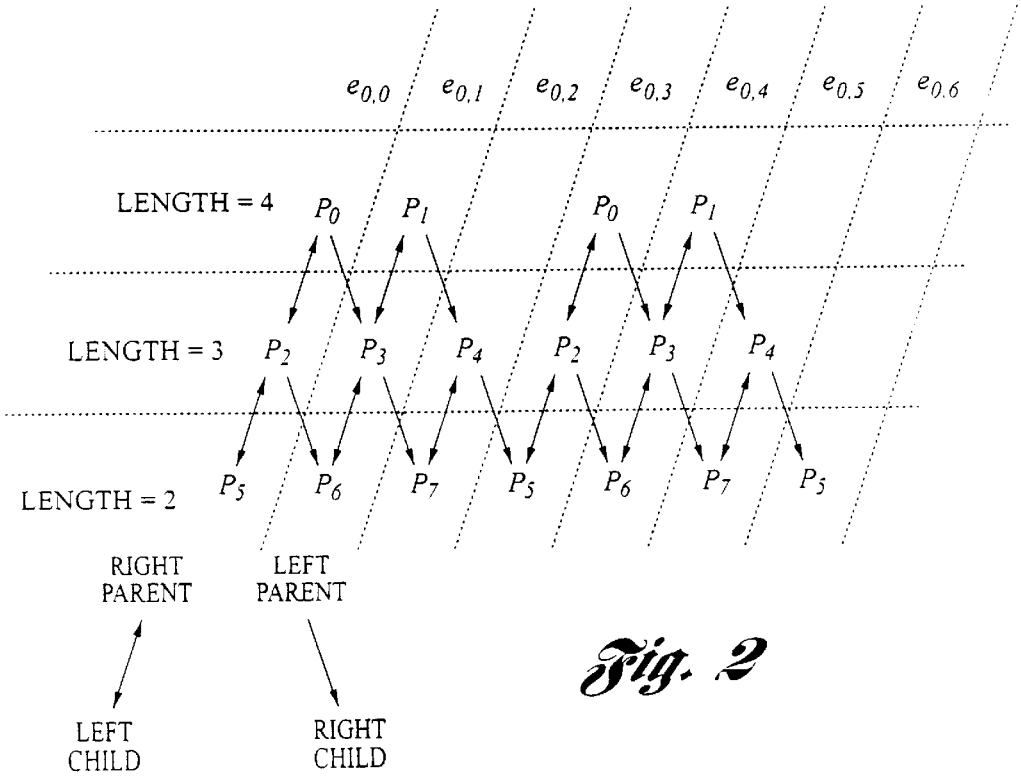
FIG. 2 is a diagram of a pattern occurrence lattice for the first phrase of Mozart's *Symphony No.* 40.
Figure 8:
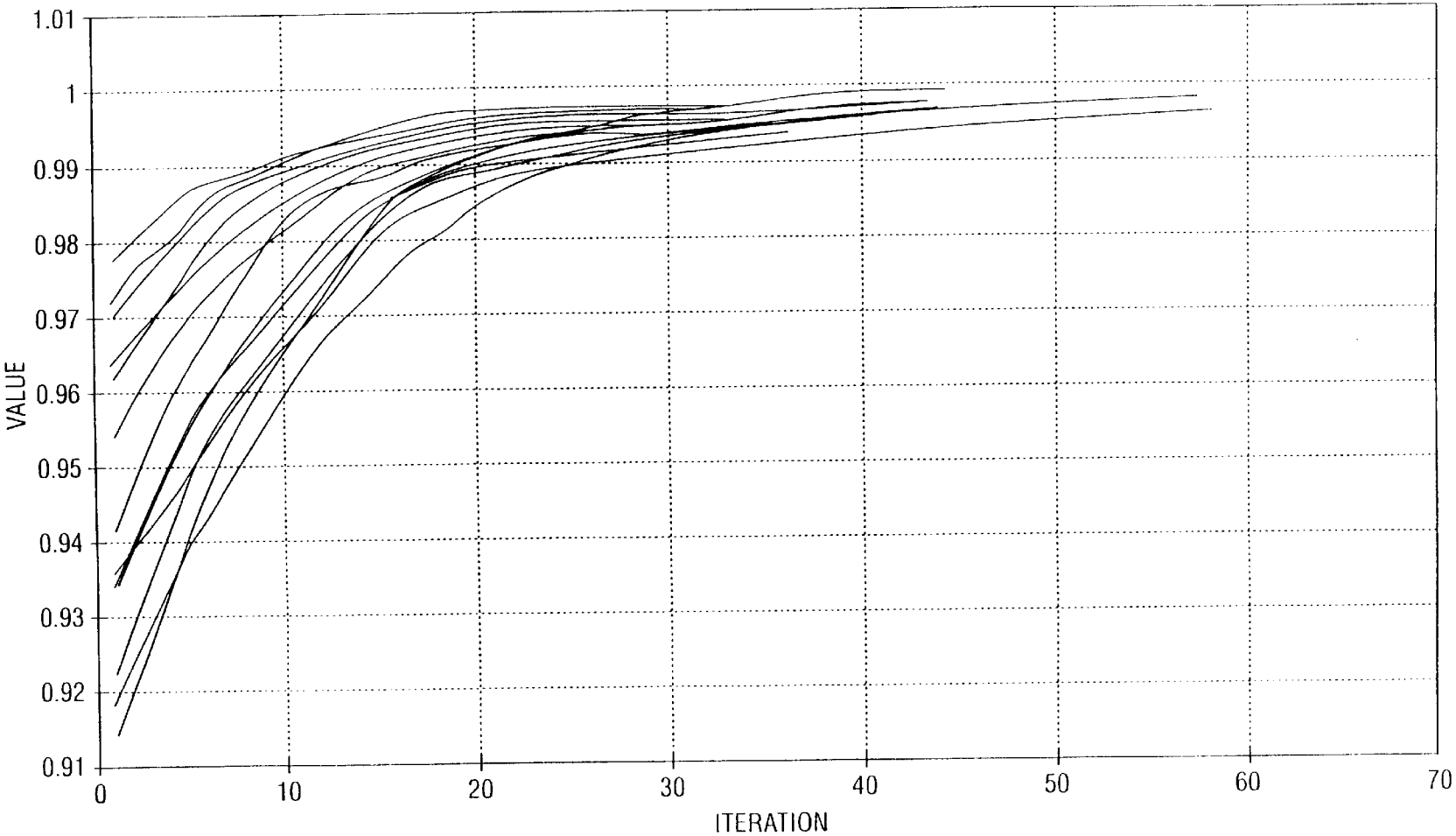
FIG. 8 is a graph of value versus iterations to illustrate hill-climbing results.

The following language is used to describe the lattice: given a node representing an occurrence of a pattern o with length l, the left child is an occurrence of length l−1 beginning at the same event. The right child is an occurrence of length l−1 beginning at the following event. The left parent is an occurrence of length l+1 beginning at the previous event, and the right parent is an occurrence of length l+1 beginning at the same event. Consider the patterns the Mozart excerpt (see Table 1): $P_0$'s first occurrence, with length 4 and at $e_{0,0}$, directly covers two other occurrences of length 3: $P_2$'s first occurrence at $e_{0,0}$ (left child) and $P_3$'s first occurrence at $e_{0,1}$ (right child). The full lattice is shown in FIG. 2. See FIG. 3 for a full description of the algorithm.

The lattice construction approach is θ(n) with respect to the number of pattern occurrences identified, which is in turn O(m*n) with respect to the maximum pattern length and the number of events in the piece, respectively.

Consider the patterns identified in the short Mozart example (Table 1), from which the lattice in FIG. 2 is built. When the first occurrence of pattern $P_4$ is inserted, $o_{left}$=the first occurrence of $P_3$, and $o_{right}$=null. Since $P_3$ has the same length as $P_4$, one checks the right parent of the $o_{left}$, and updates the link between that occurrence of $P_1$ and o. Other links are updated in a more straightforward manner.

From this lattice, non-redundant partial occurrences of patterns are identified (see FIG. 4). Take for instance pattern $P_2$ in the Mozart example. By breadth-first traversal, starting from either occurrence of $P_2$, we add the following elements to Q: $P_2$, $P_5$, $P_6$. First, we add the two occurrence of $P_2$, tagging events $e_{0,0}, e_{0,1}, \ldots, e_{0,5}$, and setting $$f \leftarrow 2 * \frac{3}{3}.$$

The first two occurrences of $P_5$ contain tagged events, so one rejects them, but the third occurrence at $e_{0,6}$ is un-tagged, so one tags $e_{0,6}$, $e_{0,7}$, $e_{0,8}$ and sets $$f \leftarrow 2 + \frac{2}{3}.$$

All occurrences of $P_6$ are tagged, so frequency of $P_2$ is equal to $$2\frac{2}{3}.$$

Register

Register is an important indicator of perceptual prevalence: one listens for higher pitched material. For the purposes of this application, register is defined in terms of the "voicing," so that for a set of n concurrent note events, the event with the highest pitch is assigned a register of 1, and the event with the lowest pitch is assigned a register value of n. For consistency across a piece, one maps register values to the range [0, 1] for any set of concurrent events, such that 0 indicates the highest pitch, 1 the lowest.

One also needs to define the notion of concurrency more precisely. Two events with intervals $I_1=[s_1, e_1]$ and $I_2=[s_2, e_2]$ are considered concurrent if there exists a common interval $I_c=[s_c, e_c]$ such that $s_c<e_c$ and $I_c \subseteq I_1 \wedge I_c \subseteq I_2$. The simplest way of computing these values is to walk through the event set ordered on onset time, maintaining a list of active events (see FIG. 5).

Consider the example piece in FIG. 2. The register values assigned to each event at each iteration are shown in Table 2.

Given these values, the register strength for a pattern P with occurrences $o_0, o_1, \ldots, o_{n-1}$ is:

$$Register[P] \leftarrow \frac{\sum_{i=0}^{n-1} \sum_{j=0}^{Length[P]} Register[e_{Phrase[o_i], Index[o_i]+j}]}{n * (Length[P] + 1)} \tag{10}$$

The register of a pattern is then simply the average register of each event in each occurrence of that pattern.

Intervallic Content

Early experiments with the system of the present invention indicated that sequences of repetitive, simple pitch interval patterns dominate given the parameters outlined thus far. For instance, in the Dvorak example (see FIG. 1) the melody is contained in the second voice from the bottom, but highly consistent, redundant figurations exist in the upper two voices. Intervallic variety provides a means of distinguishing these two types of line, and tends to favor important thematic material since that material is often more varied in terms of contour.

Given that intervallic variety is a useful indicator of how interesting a particular passage appears, one counts the number of distinct intervals observed within a pattern, not including 0. One calculates two interval counts: one in which intervals of +n or −n are considered equivalent, the other taking into account interval direction. Considering the entire Mozart, which is indeed a pattern within the context of the whole piece, there are three distinct directed intervals, −1, +1 and 8, and two distinct undirected intervals, 1 and 8.

Duration

The duration parameter is an indicator of the temporal interval over which occurrences of a pattern exist. For a given occurrence o, with initial event $e_{s_1,i_1}$ and final event $e_{s_F,i_F}$, the duration D(o)=Offset[$e_{s_F,i_F}$]−Onset[$e_{s_1,i_1}$]. For a pattern P, with occurrences $o_0, o_1, \ldots, o_{n-1}$, the distance parameter is calculated to be the average duration of all occurrences:

$$\text{Duration}[P] \leftarrow \frac{\sum_{i=0}^{n-1} D(o_i)}{n} \tag{11}$$

Rhythmic Distance

For the purposes of this application, rhythm is characterized in terms of inter-onset interval (IOI) between succes-

TABLE 2

| | Register values at each iteration of register algorithm | | | | | | | | |
|---|---|---|---|---|---|---|---|---|---|
| Adding | $e_{0,0}$ | $e_{0,1}$ | $e_{0,2}$ | $e_{0,3}$ | $e_{0,4}$ | $e_{0,5}$ | $e_{0,6}$ | $e_{0,7}$ | Active List L |
| $e_{0,0}$ | 0 | — | — | — | — | — | — | — | $\{e_{0,0}\}$ |
| $e_{0,1}$ | 1 | 0 | — | — | — | — | — | — | $\{e_{0,0}, e_{0,1}\}$ |
| $e_{0,2}$ | 1 | 0 | $\frac{1}{2}$ | — | — | — | — | — | $\{e_{0,0}, e_{0,1}, e_{0,2}\}$ |
| $e_{0,3}$ | 1 | 0 | 1 | 0 | — | — | — | — | $\{e_{0,0}, e_{0,3}\}$ |
| $e_{0,4}, e_{0,5}$ | 1 | 0 | 1 | $\frac{2}{3}$ | $\frac{1}{3}$ | 0 | — | — | $\{e_{0,2}, e_{0,3}, e_{0,4}, e_{0,5}\}$ |
| $e_{0,6}, e_{0,7}$ | 1 | 0 | 1 | $\frac{2}{3}$ | $\frac{1}{3}$ | 0 | $\frac{1}{2}$ | 1 | $\{e_{0,4}, e_{0,6}, e_{0,7}\}$ |

sive events. One calculates the distance between a pair of occurrences as the angle difference between the vectors built from the IOI values of each occurrence. For an occurrence o with events $e_0, e_1, \ldots, e_n$, where n is the pattern length, the IOI vector is $V(o)=\langle onset[e_1]-onset[e_0], onset[e_2]-onset[e_1], \ldots, onset[e_n]-onset[e_{n-1}]\rangle$. The rhythmic distance between a pair of occurrences $o_a$ and $o_b$ is then the angle difference between the vectors $V(o_a)$ and $v(o_b)$:

$$D(o_a, o_b) = \cos^{-1}\left(\frac{V(o_a)\cdot V(o_b)}{\|V(o_a)\|\|V(o_b)\|}\right) \tag{12}$$

One takes the average of the distances between all occurrence $(o_0, o_1, \ldots, o_{n-1})$ pairs for a pattern P to calculate its rhythmic distance:

$$\text{Distance}[P] \leftarrow \frac{\sum_{i=0}^{n-2}\sum_{j=i+1}^{n-1} D(V(o_i), V(o_j))}{\frac{n(n-1)}{2}} \tag{13}$$

This value is a measure of how similar different occurrences are with respect to rhythm. Two occurrences with the same notated rhythm presented at different tempi have a distance of 0. Consider the case where $o_a$ has k times the temp of $o_b$. In this case, $V(o_b)=kV(o_a)$, and $V(o_a)=\langle i_0, i_1, \ldots i_{n-1}\rangle$:

$$\begin{aligned} D(o_a, o_b) &= \cos^{-1}\left(\frac{ki_0^2 + ki_1^2 + \ldots + ki_{n-1}^2}{\sqrt{(ki_0)^2 + (ki_1)^2 + \ldots (ki_{n_2-1})^2}\sqrt{i_0^2 + i_1^2 + \ldots i_{n-1}^2}}\right) \\ &= \cos^{-1}\left(\frac{ki_0^2 + ki_{1_}^2 \ldots + ki_{n-1}^2}{\sqrt{k^2(i_0^2 + i_1^2 + \ldots i_{n-1}^2}\sqrt{i_0^2 + i_{1_}^2 \ldots i_{n-1}^2}}\right) \\ &= \cos^{-1}(1) \\ &= 0 \end{aligned} \tag{14}$$

Occurrences with similar rhythmic profiles have low distance, so this approach is robust with respect to performance and compositional variation, such as rubato, expansion and so forth.

For instance, in the *Well-Tempered Clavier,* Bach often repeats fugue subjects at half speed. The rhythm vectors for the main subject statement and the subsequent expanded statement will thus have the same angle.

Doublings

Doublings are a special case in the invention. A "doubled" passage occurs where two or more voices simultaneously play the same line. In such instances, only one of the simultaneous occurrences is retained for a particular pattern, the highest sounding to maintain the accuracy of the register measure.

One must provide a definition of simultaneity to clearly describe this parameter. To provide for inexact performance, one allows for a looser definition: two occurrences $o_a$ and $o_b$, with initial events $e_{s_a,i_a}$ and $e_{s_b,i_b}$ respectively, and length m, are considered simultaneous if and only if $\forall j, 0 \leqq j \leqq m$, $e_{s_a,i_{a+j}}$ overlaps $e_{s_b,i_{b+j}}$. Two events $e_{s_1,i_1}$ and $e_{s_2,i_2}$ are, in turn, considered overlapping if they strictly intersect. It is easier to check for the non-intersecting relations—using the conventions and notations of Beek's *The Design and Experimental Analysis of Algorithms for Temporal Reasoning*—$e_{2_1,i_1}$ before (b) $e_{s_2,i_2}$ or the inverse (bi) (see FIG. 7):

$$\begin{aligned} \text{Intersects}(e_{s_1,i_1}, e_{s_2,i_2}) &= \neg(b(e_{s_1,i_1}, e_{s_2,i_2}) \vee bi(e_{s_1,i_1}, e_{s_2,i_2})) \\ &= \neg(\text{Offset}[e_{s_1,i_1}] < \text{Onset}[e_{s_2,i_2}]) \wedge \\ &\quad \neg(\text{Onset}[e_{s_1,i_1}] > \text{Offset}[e_{s_2,i_2}]) \end{aligned} \tag{15}$$

Each occurrence of a pattern is checked against every other occurrence. Since occurrences are sorted on onset, one knows that if $o_i$ and $o_j$ are not doublings, where j>i, $o_i$ cannot double $o_k$ for all k>j. This provides a way of curtailing searches for doublings in the algorithm of the present invention (see FIG. 7).

This doubling filtering occurs before all other calculations, and thus influences frequency. One, however, retains the doubling information, as it is a musical emphasis technique.

Pattern Position

Noting that significant themes are often introduced near the start of a piece, one also characterizes patterns according to the onset time of their first occurrence, or $\text{Onset}[e_{stream[o_0],Index[o_0]}]$.

Rating Patterns

For each pattern P, parameter values are calculated. One is interested in comparing the importance of these patterns, and a convenient means of doing this is to calculate percentile values for each parameter in each pattern, corresponding to the percentage of patterns over which a given pattern is considered stronger for a particular parameter. These values are stored in a feature vector:

$$\begin{aligned} F(P) = \langle &Plength, Pduration, PintervalCount, \\ &PundirectedIntervalCount, Pdoublings, Pfrequency, \\ &PrythmicDistance, Pregister, Pposition\rangle \end{aligned} \tag{16}$$

One defines "stronger" as either "less than" or "greater than" depending on the parameter. Higher values are considered desirable for length, duration, interval counts, doublings and frequency; lower values are desirable for rhythmic distance, pattern position and register.

The rating of pattern P, given some weighting of parameters W, is:

$$\text{Rating}[P] \leftarrow W \cdot F(P) \tag{17}$$

Patterns are then sorted according to their Rating field. This sorted list is scanned from the highest to the lowest rated pattern until some pre-specified number (k) of note events has been returned. Often, the present invention (i.e., MME) will rate a sub-sequence of an important theme highly, but not the actual theme, owing to the fact that parts of a theme are more faithfully repeated than others. As such, MME will return an occurrence of a pattern with an added margin on either end, corresponding to some ratio g of the occurrences duration, and some ratio of the number of note events h, whichever ratio yields the tightest bound.

In order to return a high number of patterns within k events, one uses a greedy algorithm to choose occurrences of patterns when they are added: whichever occurrence adds the least number of events is used.

Output from MME is then a MIDI file consisting of a single channel of monophonic (single voice) note events, corresponding to important thematic material in the input piece.

As described above, the method and system of the present invention rapidly searches digital score representations of music (e.g., MIDI) for patterns likely to be perceptually significant to a human listener. These patterns correspond to major themes in musical works. However, the invention can also be used for other patterns of interest (e.g., scale passages or "quotes" of other musical works within the score being analyzed). The method and system perform robustly across a broad range of musical genres, including "problematic" areas such as large-scale symphonic works and impressionistic music. The invention allows for the abstraction of musical data for the purposes of search, retrieval and analysis. Its efficiency makes it a practical tool for the cataloging of large databases of multimedia data.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method for extracting melodic patterns in a musical piece, the method comprising:

receiving data which represents the musical piece;

segmenting the data to obtain musical phrases;

recognizing patterns in each phrase to obtain a pattern set;

calculating parameters including frequency of occurrence for each pattern in the pattern set; and identifying desired melodic patterns based on the calculated parameters.

2. The method as claimed in claim 1 further comprising filtering the pattern set to reduce the number of patterns in the pattern set.

3. The method as claimed in claim 1 wherein the data is note event data.

4. The method as claimed in claim 1 wherein the step of segmenting includes the steps of segmenting the data into streams which correspond to different voices contained in the musical piece and identifying obvious phase breaks.

5. The method as claimed in claim 1 wherein the step of calculating includes the step of building a lattice from the patterns and identifying non-redundant partial occurrences of patterns from the lattice.

6. The method as claimed in claim 1 wherein the parameters include temporal interval.

7. The method as claimed in claim 1 wherein the parameters include rhythmic strength.

8. The method as claimed in claim 1 wherein the parameters include register strength.

9. The method as claimed in claim 1 wherein the step of identifying the desired melodic patterns includes the step of rating the patterns based on the parameters.

10. The method as claimed in claim 9 wherein the step of rating includes the steps of sorting the patterns based on the parameters and identifying a subset of the input piece containing the highest-rated patterns.

11. The method as claimed in claim 1 wherein the melodic patterns are major themes.

12. The method as claimed in claim 1 wherein the step of recognizing is based on melodic contour.

13. The method as claimed in claim 2 wherein the step of filtering includes the step of checking if the same pattern is performed in two voices substantially simultaneously.

14. The method as claimed in claim 2 wherein the step of filtering is performed based on intervallic content.

15. The method as claimed in claim 2 wherein the step of filtering is performed based on internal repetition.

16. A system for extracting melodic patterns in a musical piece, the system comprising:

means for receiving data which represents the musical piece;

means for segmenting the data to obtain musical phrases;

means for recognizing patterns in each phrase to obtain a pattern set;

means for calculating parameters including frequency of occurrence for each pattern in the pattern set; and means for identifying desired melodic patterns based on the calculated parameters.

17. The system as claimed in claim 16 further comprising means for filtering the pattern set to reduce the number of patterns in the pattern set.

18. The system as claimed in claim 16 wherein the data is note event data.

19. The system as claimed in claim 16 wherein the means for segmenting includes means for segmenting the data into streams which correspond to different voices contained in the musical piece and means for identifying obvious phrase breaks.

20. The system as claimed in claim 16 wherein the means for calculating includes means for building a lattice from the patterns and means for identifying non-redundant partial occurrences of patterns from the lattice.

21. The system as claimed in claim 16 wherein the parameters include temporal interval.

22. The system as claimed in claim 16 wherein the parameters include rhythmic strength.

23. The system as claimed in claim 16 wherein the parameters include register strength.

24. The system as claimed in claim 16 wherein the means for identifying the desired melodic patterns includes means for rating the patterns based on the parameters.

25. The system as claimed in claim 24 wherein the means for rating includes means for sorting the patterns based on the parameters and means for identifying a subset of the input piece containing the highest-rated patterns.

26. The system as claimed in claim 16 wherein the melodic patterns are major themes.

27. The system as claimed in claim 16 wherein the means for recognizing recognizes patterns based on melodic contour.

28. The system as claimed in claim 17 wherein the means for filtering includes means for checking if the same pattern is performed in two voices substantially simultaneously.

29. The system as claimed in claim 17 wherein the means for filtering filters based on intervallic content.

30. The system as claimed in claim 17 wherein the means for filtering filters based on internal repetition.

31. A computer-readable storage medium having stored therein a program which executes the steps of:

receiving data which represents a musical piece;

segmenting the data to obtain musical phrases;

recognizing patterns in each phrase to obtain a pattern set;

calculating parameters including frequency of occurrence for each pattern in the pattern set; and identifying desired melodic patterns based on the calculated parameters.

32. The storage medium as claimed in claim 31 wherein the program further executes the step of filtering the pattern set to reduce the number of patterns in the pattern set.

33. The storage medium as claimed in claim 31 wherein the data is note event data.

34. The storage medium as claimed in claim 31 wherein the step of segmenting includes the steps of segmenting the data into streams which correspond to different voices contained in the musical piece and identifying obvious phrase breaks.

35. The storage medium as claimed in claim 31 wherein the step of calculating includes the step of building a lattice from the patterns and identifying non-redundant partial occurrences of patterns from the lattice.

36. The storage medium as claimed in claim 31 wherein the parameters include temporal interval.

37. The storage medium as claimed in claim 31 wherein the parameters include rhythmic strength.

38. The storage medium as claimed in claim 31 wherein the parameters include register strength.

39. The storage medium as claimed in claim 31 wherein the step of identifying the desired melodic patterns includes the step of rating the patterns based on the parameters.

40. The storage medium as claimed in claim 39 wherein the step of rating includes the steps of sorting the patterns based on the parameters and identifying a subset of the input piece containing the highest-rated patterns.

41. The storage medium as claimed in claim 31 wherein the melodic patterns are major themes.

42. The storage medium as claimed in claim 31 wherein the step of recognizing is based on melodic contour.

43. The storage medium as claimed in claim 32 wherein the step of filtering includes the step of checking if the same pattern is performed in two voices substantially simultaneously.

44. The storage medium as claimed in claim 32 wherein the step of filtering is performed based on intervallic content.

45. The storage medium as claimed in claim 32 wherein the step of filtering is performed based on internal repetition.

* * * * *